US006301519B1

(12) United States Patent
Motz

(10) Patent No.: US 6,301,519 B1
(45) Date of Patent: Oct. 9, 2001

(54) METHOD AND APPARATUS FOR CONTROLLING AND MONITORING THE CUTTING FUNCTION OF A THREAD CUTTER DRIVEN BY AN ELECTRIC MOTOR IN LOOMS

(75) Inventor: Kurt Motz, Lindau (DE)

(73) Assignee: Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/047,473

(22) Filed: Mar. 25, 1998

(30) Foreign Application Priority Data

Mar. 27, 1997 (DE) ..... 19 713 089

(51) Int. Cl.[7] ..... G06F 19/00
(52) U.S. Cl. ..... 700/141; 700/140
(58) Field of Search ..... 700/141, 140, 700/142, 143, 130, 131, 132, 134, 135, 136, 137, 139, 90, 117; 139/12, 436, 126

(56) References Cited

U.S. PATENT DOCUMENTS 3,570,550 * 3/1971 Budzyna ..... 139/1
3,732,896 * 5/1973 Jekl et al. ..... 139/12
3,895,657 * 7/1975 Bilek ..... 139/125
4,158,373 * 6/1979 Onikov et al. ..... 139/436
4,159,558 * 7/1979 Durville et al. ..... 26/10 R
4,480,665 * 11/1984 Imamura et al. ..... 139/97
4,746,848 * 5/1988 Maenaka et al. ..... 318/603
4,834,145 * 5/1989 Lewyllie et al. ..... 139/429
4,850,399 * 7/1989 Linka et al. ..... 139/436
4,892,120 * 1/1990 Bostyn ..... 139/21
5,123,455 * 6/1992 Maina ..... 139/452
5,158,119 * 10/1992 Pezzoli et al. ..... 139/434
5,329,962 * 7/1994 Ohnishi et al. ..... 139/450
5,735,315 * 4/1998 Petsche et al. ..... 139/68

FOREIGN PATENT DOCUMENTS 40 00 856 7/1991 (DE) .
0 284 766 10/1988 (EP) .

* cited by examiner

*Primary Examiner*—Thomas Lee
*Assistant Examiner*—Ri Jue Mai
(74) *Attorney, Agent, or Firm*—Cowell & Moring LLP

(57) ABSTRACT

A method and apparatus is provided for controlling and monitoring the cutting function of a thread cutter driven by an electric motor in looms. The monitoring of the cutting function is effected by monitoring the rotation of the motor shaft of the cutter drive. To accomplish this, a magnetic pick-up and a permanent magnet are used which are supported at relatively movable parts of the cutter drive.

10 Claims, 1 Drawing Sheet

METHOD AND APPARATUS FOR CONTROLLING AND MONITORING THE CUTTING FUNCTION OF A THREAD CUTTER DRIVEN BY AN ELECTRIC MOTOR IN LOOMS

BACKGROUND AND SUMMARY OF THE INVENTION

This application claims the priority of German application 197 13 089.5-26 filed in Germany on Mar. 27, 1997, the disclosure of which is expressly incorporated by reference herein.

The present invention relates to a method for controlling and monitoring the cutting function of a thread cutter driven by an electric motor in looms, said thread cutter having a stationary part and a movable cutter part which performs a cutting movement.

From the German patent 40 00 856 A1, a thread cutter is known for cutting the inserted filling thread in looms. Here, the cutter is mechanically coupled with the main drive of the loom by a cam mechanism, or the like. The thread cutter operates synchronously with the rhythm of the machine. The moment (timing) of the cutting is therefore predetermined in a fixed manner with respect to the weaving cycle and is not variable or is variable only by major mechanical conversions.

A substantially more flexible thread cutter for filling threads is known from EP 0 284 766 B1. That thread cutter has a drive, which is independent of the main drive, so that the time of the cutting process can be predetermined as desired with respect to the weaving cycle by means of a programmable control unit. The drive includes a stepping motor having a shaft drivingly connected with a movable knife, which stepping motor is alternatively rotationally driven back and forth.

The alternating forward and backward rotation of the motor shaft, however, has the disadvantage that the stepping motor is exposed to high stresses and high wear by the continuous accelerating and decelerating processes. Furthermore, no monitoring of the thread cutter for damage thereto is provided.

An object of the invention is to provide an improved method for controlling and monitoring the cutting function of a thread cutter, which is driven by an electric motor, and serves for the cutting off of selvage while permitting a great flexibility in performing the cutting function and use under many different mechanical circumstances and in a diversity of places.

Another object of the invention is to increase the service life of the cutter drive and to provide a monitoring of the function of the thread cutter and of damage to it.

These and other objects are achieved according to preferred embodiments of the present invention by providing a method and apparatus for controlling and monitoring the cutting function of electromotively driven thread cutters in looms, having a main shaft driven in rotation, the cutter drive being an electric drive motor with a programmable electronic control unit, which is connected in signal-transmitting manner with a loom control, wherein, upon rotation of the motor shaft of the drive motor, at least one electric signal is produced and the electric signal is communicated to the loom control via the control electronics, and upon absence of the signal, the weaving process is interrupted.

Preferred embodiments of the invention have the advantage that, for instance, the motor of a selvage cutter can be driven continuously in one direction of rotation during the operation of the thread cutter and need not pass through starting and stopping cycles. This increases the service life of the motor.

The speed of rotation of the motor, and thus the cutting cycle and cutting time, are controlled and monitored by an electronic control mechanism according to preferred embodiments of the invention. The electronic control mechanism is advantageously integrated into the machine control and can be programmed via the control panel.

In certain preferred embodiments of the invention, rotation of the motor shaft is monitored by a monitoring device in the form of a sensor. In this connection, a magnetic receiver (Hall sensor) is preferably used, because of the surrounding conditions. Embodiments are also contemplated which use optical, capacative, inductive or other monitors, dependent on the specific conditions. By this type of monitoring, defects of the drive motor as well as breakage or jamming of the movable cutter part of the thread cutter can advantageously be detected.

In order to increase the service life of the thread cutter, according to certain preferred embodiments of the invention, provisions are made so that the speed of rotation of the motor shaft of the cutter motor can be operated at any adjustable ratio to the speed of rotation of the motor shaft of the loom drive. This means that, in the case of a fabric of relatively high filling density, the thread cutter cuts for instance in a ratio of 1:5 to the filling insertion (pick). In other words, after each filling insertion process, there is a single cutting for several filling threads, which are bound in the fabric and a selvage. Therefore, the filling threads of in each case the last five picks are cut between the fabric and the selvage.

There is furthermore the advantage of preferred embodiments of the invention that, depending on the filling material and the weaving design, different ratios of speed of rotation may also exist during repeat weavings with high pick density.

The inventive thread cutter is intended, in particular, for cutting off selvages since, as a result of the predeterminable ratio of speed of rotation of the cutter drive to the main shaft drive of the loom, several picks which have already been entered, can in advantageous fashion be cut by a single cutting process.

Due to the great flexibility in mounting and control, the thread cutter assembly according to certain preferred embodiments of the invention can be used just as well as a separate central cutting device for cutting a fabric web in the direction opposite the weaving direction for cutting each individual pick entered.

Other objects, advantages and novel features of the present invention will become apparent from the following detailed description of the invention when considered in conjunction with the accompanying drawings.

DETAILED DESCRIPTION OF THE DRAWINGS

Figure 1:
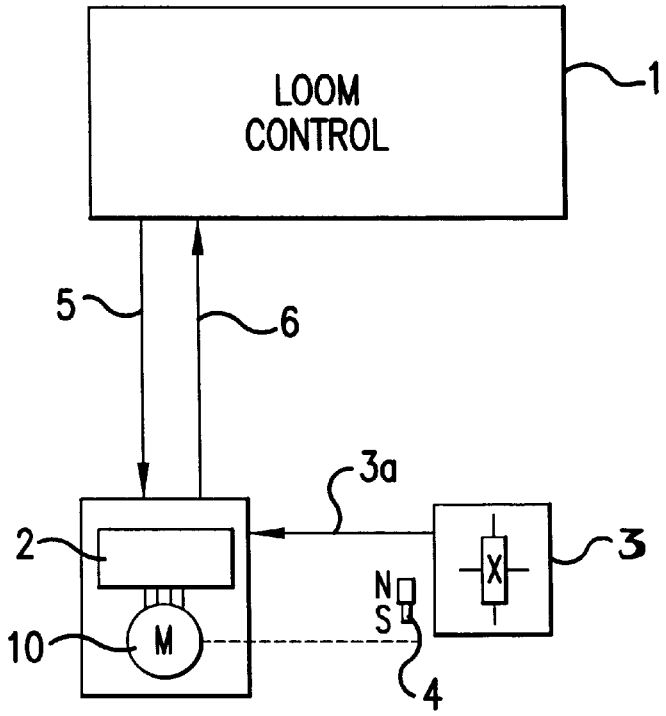
FIG. 1 shows a block diagram for controlling a cutter drive by loom control and the flow of signals from the monitoring device to the control of the loom, constructed according to preferred embodiments of the invention.

FIG. 1 shows diagrammatically a drive 10 of a thread cutter with control electronics 2 and a signal-transmitting connection 5, 6 of the latter to a loom control 1. The drive comprises an electric motor 10, which is preferably constructed as a stepping motor, and control electronics 2 for controlling the motor functions.

The control electronics 2 are connected via a signal line with the loom control 1, and from the loom control receive control information for controlling the motor (for instance, speed of rotation, direction of rotation, synchronization signals, etc.).

The speed of rotation of the motor 10 of the thread cutter 7, which has been preprogrammed in the loom control 1, is monitored by a monitoring device 3, 4. The monitoring device 3, 4 is connected via a signal line 3*a* with the control electronics 2 which, in turn, is connected with the loom control 1 via the signal line 6. This produces a closed loop, which assures dependable monitoring of the operation of the motor of the thread cutter. The monitoring device preferably includes a magnetic pick-up 3. On a shaft 11 of the motor 10 or on a part firmly attached to it is a permanent magnet device 4. Upon each complete revolution of the motor shaft 11, magnet 4 passes by the pick-up 3 and a signal is detected by the control electronics 2. The signal is supplied over the signal line 6 to the loom control 1.

If a defect occurs in the motor 10, or if the thread cutter has jammed, then the motor shaft 11 does not rotate. As a result, the pick-up 3 is not energized. The control electronics 2 sends out an error signal to the loom control 1. An error-signal evaluation then takes place in the loom control, as a result of which (for instance) the weaving process is stopped.

Figure 2:
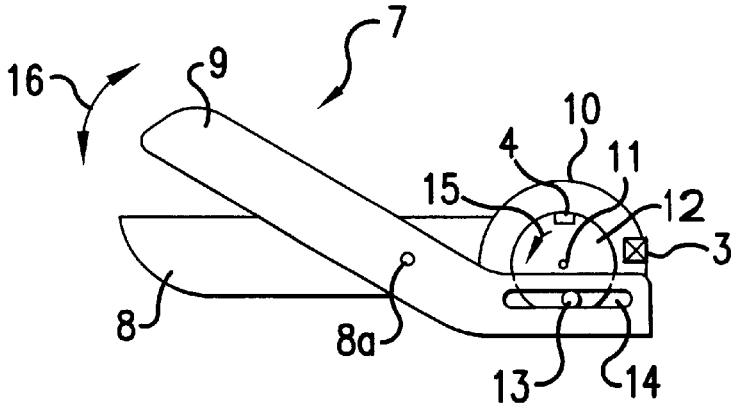
FIG. 2 shows diagrammatically the construction and manner of operation of the thread cutter according to preferred embodiments of the invention.

One contemplated development of the thread cutter is shown diagrammatically in FIG. 2. The thread cutter 7 includes a stationary cutting part 8 and a movable cutting part 9. The motor 10 is arranged on the stationary cutter part 8. The motor 10 bears a driver disk 12 on its motor shaft 11. The motor shaft 11 rotates with a predeterminable speed of rotation in a direction 15.

The movable part 9 of the cutter is arranged pivotably about the cutter axis 8*a* with respect to the stationary cutter part 8 and comprises a slot 14 which is engaged by a driver pin on its end facing away from the cutter blades. The driver pin 13 is arranged fixed in the edge region of the driver disk 12. By the eccentric arrangement of the driver pin 13 with respect to the motor shaft 11, the rotary movement of the motor shaft 11 is converted into a cutting movement of the movable cutter part 9 in a direction of the double arrow 16. In this connection, a full revolution of the motor shaft 11 of the motor 10 corresponds to a cutting cycle of the thread cutter 7.

The monitoring device 3, 4 is arranged on the motor 10 and comprises a permanent magnet 4 which is arranged, for instance, on the driver disk 12 and which passes by a stationary magnetic pick-up 3 such as a Hall sensor upon each revolution of the shaft 11 of the motor. The Hall sensor feeds an electric signal to the control electronics 2 upon each rotation of the motor shaft 11.

If for any reason the motor should stop rotating or non-foreseeable irregularities occur, the control electronics 2 recognizes this and feeds an error signal to the loom control 1. Thereupon, an error routine is initiated and, if necessary, the weaving process is stopped.

An electromotive drive of a thread cutter, the motor shaft of which alternately rotates forward and backward in accordance with the prior art and therefore carries out a partial revolution, can also be monitored pursuant to the invention. Such a thread cutter is used as a filling-thread cutter. However, the ratio of the partial rotation of the motor shaft of the cutter motor to the speed of rotation of the main shaft of the drive of the loom plays no role in controlling the filling thread cutter.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A thread cutter driven by an electric motor for use as a selvage cutter in looms, having:

a stationary cutter part and a movable cutter part which carries out a cutting movement, and an electric motor driving the movable cutter part around a cutter pivot, the electric motor having a programmable electronic control unit, which is in signal-transmitting relationship to a loom control, wherein a motor shaft of the electric motor or at least an arrangement present on the motor shaft, has a first device, and wherein a second device is present outside the region of rotation of the motor shaft, said first and second devices being part of a monitoring unit monitoring the rotating movement of the motor shaft and operable to communicated a signal to the loom control which is indicative of an operating condition of the thread cutter to facilitate interruption of weaving operations in an event of predetermined unacceptable cutter operation.

2. The thread cutter according to claim 1, wherein the first device is a receiver of a physical magnitude and at the same time a transmitter of an electrical magnitude, and wherein the second device is a transmitter of the physical magnitude.

3. The thread cutter according to claim 2, wherein the first device is in signal-transmitting communication via control electronics with the loom control.

4. A thread cutter assembly for a loom which has a programmable loom control unit, said cutter assembly comprising:

first and second relatively movable cutter parts driven by an electric cutter driving motor which drives a cutter shaft in one rotational direction during cutting operations;

a programmable electronic control unit operable to control the cutter driving motor, said electronic control unit being in a signal transmitting relationship to the loom control unit; and a cutter operation monitoring assembly, including a first part carried by the cutter shaft and a second part separate from the cutter shaft, said first and second parts monitoring rotational movement of the cutter shaft and being operable to generate an electric cutter operation signal which is indicative of the operational condition of the cutter drive shaft, said electric cutter operation signal being communicated by the electronic control unit to the loom control unit as a function of the operational condition of the cutter driving motor.

5. The cutter assembly of claim 4, wherein the cutter monitoring assembly is operable to detect one partial revolution and a complete revolution of the cutter shaft.

6. The cutter assembly of claim 5, wherein the cutter monitoring assembly is operable to produce said cutter operation signal in response to a partial or complete revolution of the driving motor.

7. The cutter assembly of claim 6, wherein the cutter monitoring assembly includes a Hall sensor.

8. A thread cutter driven by an electric motor for use in looms, having:

a stationary cutter part and a movable cutter part which carries out a cutting movement, and an electric motor driving the movable cutter part around a cutter pivot, the electric motor having a programmable electronic control unit, which is in signal-transmitting relationship to a loom control, wherein a motor shaft of the electric motor or at least an arrangement present on the motor shaft, has a first device, and wherein a second device is present outside the region of rotation of the motor shaft, said first and second devices being part of a monitoring unit monitoring the rotating movement of the motor shaft and operable to communicate a signal to the loom control which is indicative of an operating condition of the thread cutter to facilitate interruption of weaving operations in an event of predetermined unacceptable cutter operation.

9. The thread cutter according to claim 8, wherein the first device is a receiver of a physical magnitude and at the same time a transmitter of an electrical magnitude, and wherein the second device is a transmitter of the physical magnitude.

10. The thread cutter according to claim 9, wherein the first device is in signal-transmitting communication via control electronics with the loom control.

* * * * *